United States Patent [19]

Tanaka et al.

[11] Patent Number: 5,035,752

[45] Date of Patent: Jul. 30, 1991

[54] METHOD FOR PROCESSING A VIBRATORY SURFACE

[75] Inventors: Katsumasa Tanaka; Hitoshi Satoh; Heijiro Kawakami, all of Kobe; Nobuaki Marukawa, Toyonaka, all of Japan

[73] Assignee: Kabushiki Kaisha Kobe Seiko Sho, Kobe, Japan

[21] Appl. No.: 540,700

[22] Filed: Jun. 20, 1990

[30] Foreign Application Priority Data

Feb. 1, 1990 [JP] Japan ..... 2-24133

[51] Int. Cl.[5] ..... B08B 1/02; B08B 3/10

[52] U.S. Cl. ..... 134/32; 134/137; 134/138

[58] Field of Search ..... 134/32, 137, 138

[56] References Cited

FOREIGN PATENT DOCUMENTS 61-69276 12/1986 Japan .

*Primary Examiner*—Theodore Morris
*Assistant Examiner*—Zeinab El-Arini
*Attorney, Agent, or Firm*—Oblon, Spivak, McClelland, Maier & Neustadt

[57] ABSTRACT

A method for processing a vibratory surface in which a processed object is hung on a hook, the hook is supported by the supporting frame having an air spring, the object is immersed in a surface treating liquid. The height of the air spring is automatically adjusted to the most suitable standard height in response to a weight of the processed object and then the surface treatment is carried out while the hook is being vibrated. An apparatus for performing this vibratory surface treatment method is provided.

4 Claims, 6 Drawing Sheets

METHOD FOR PROCESSING A VIBRATORY SURFACE

BACKGROUND OF THE INVENTION

1. Field of the Invention

This invention relates to a method for processing a surface and apparatus for processing the surfaces of various iron and steel products, such as a pickling, cleaning and coating and the like, for example and in particular provides a processing method and apparatus which are preferable for the so-called pickling for use in pickling and removing scale generated in the surface of a wire member by immersing the wire member wound into a coil form in the pickling liquid.

2. Description of the Related Art

A scale is generated at a surface of a wire material processed by a surface treatment of an iron and steel product, for example, manufactured through a hot rolling process, i.e. the wire material heat treated during a secondary machining process and if these wire materials are to be processed further through various machining processes at the subsequent stages, it is necessary to remove the scale with a proper means. The pickling process of the coil of wire material of the present invention will be described as follows. As the descaling process, there are a mechanical descaling process and a chemical descaling method. These two processes are selected separated in response to a surface condition of the wire material and a foundation state of a plant and the like and in general, a batch type pickling process is widely applied as a descaling process for these wire materials.

SUMMARY OF THE INVENTION

The present invention has as an object to accommodate above problems and to provide a method and apparatus for processing a vibratory surface in which a height of an air spring acting as a dampening device can easily be adjusted to its most appropriate standard height in respect to a variation of weight of the coil of wire material of a treated object without reducing the production capability during the processing of the vibratory surface.

It is another object of the present invention to provide a method and apparatus for processing the vibratory surface in which a uniform surface treatment can be performed in response to a variation of weight of a treated object (a coil of the wire material) and a product having a stable quality can be provided.

It is a still further object of the present invention to provide a method and apparatus for processing a vibratory surface in which an automatic transporting work can be carried out and a production capability of the vibratory surface processing facility can be improved by enabling a height of an air spring acting as a dampening device to be easily adjusted to its most appropriate standard height.

DESCRIPTION OF THE PREFERRED EMBODIMENTS

Figure 11:
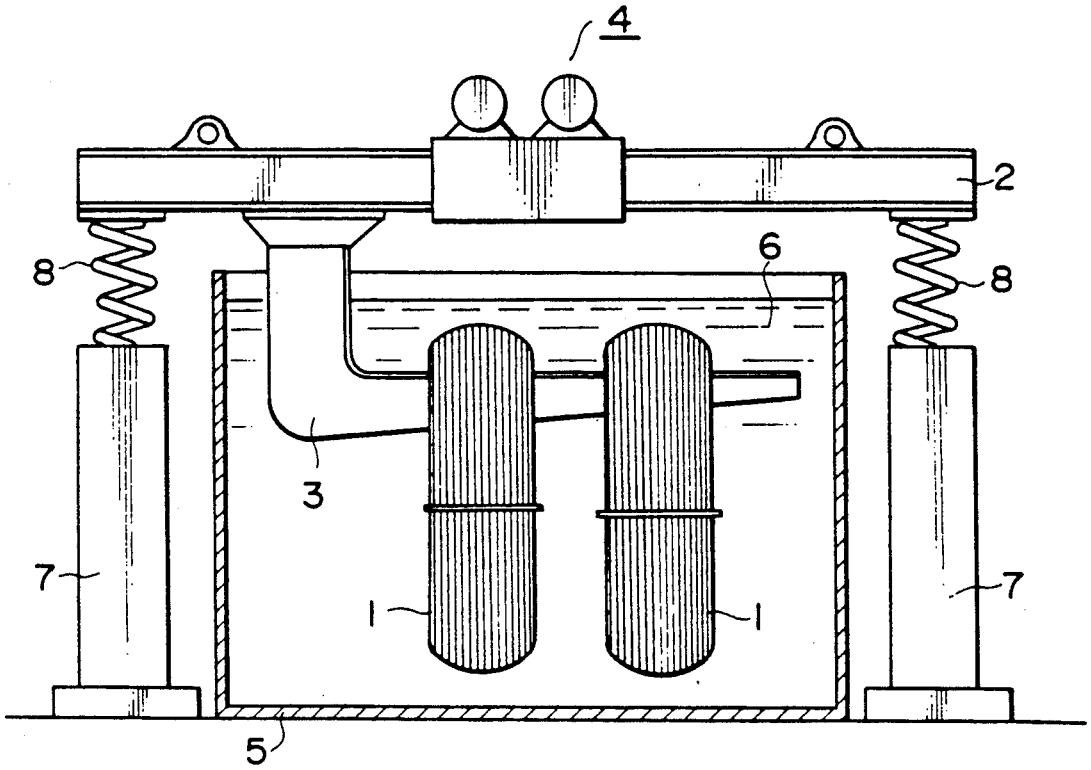
FIG. 11 (PRIOR ART)
FIG. 11 is a schematic front elevational view for showing a conventional processing device for performing a method for processing a vibratory surface in the prior art.

This batch type pickling process is carried out such that a coil of wire material is hung on a hook to be used for a transporting operation, the coil is immersed temporarily in the pickling liquid with this hook so as to chemically dissolve and remove oxidized iron on the surface of the wire material. In such a batch type pickling process as described above, a vibratory pickling process for performing a pickling operation is carried out by applying a vibration to the coil of wire material in the pickling liquid to vibrate the wire material hung on the hook and sufficiently introduce the pickling liquid into the clearances of the wire materials so as to increase a processing speed and to get a uniform surface characteristic. That is, as shown in FIG. 11, the coil 1 of wire material is hung on a hanger-like hook 3 (called as a hair pin hook) fixed to a lower part of a hook beam 2. The hook beam 2 is transported by a running crane or a hoist and lifted or ascended at a predetermined part. To the top surface of the hook beam 2 is fixed a vibration applying device 4 and as the vibration applying device, an eccentric crank type or an eccentric type weight directly connected to an electric motor is utilized. This figure shows a state in which the coil 1 of wire material is immersed in a pickling tub 5 and pickling liquid 6 is stored in the pickling tub 5. In case of installing the hook beam 2, it is carried on mounting tables 7 and 7, vertically arranged at both aides of the pickling tub 5, via dampening devices 8 and 8. Although the coil 1 of wire material is vibrated through energization of the vibrating device 4, the vibration is applied in a hanging direction of the coil of wire material so as to open the clearances of the wire materials or close them to perform a uniform processing of the material by vibrating the coil 1 of wire material vertically.

However, in case of such a device as described above, a vibrating means for vibrating the coil of wire material must be arranged in each of the hooks. In this case, this type of device has the following disadvantages, i.e.

(I) As the number of hooks for improving production capability and working characteristic, the number of vibrating applying devices corresponding to that number are required, resulting in that a cost of the facility is increased;

(II) Since the weight of the hook includes that of the vibration applying device, it becomes a large weight and its working characteristic is not superior;

(III) Although the vibration applying device on the hook may require a protection against a dispersion of liquid during a processing time and fumes of the liquid, the hook itself must be moved, so that a certain restriction exists in its structure for fixing a protecting structure;

(IV) In case of performing a processing, it is necessary to connect the vibration applying device on the hook with a power source and it is necessary to always have a worker, there resulting in that a production capability is not superior.

Figure 12:
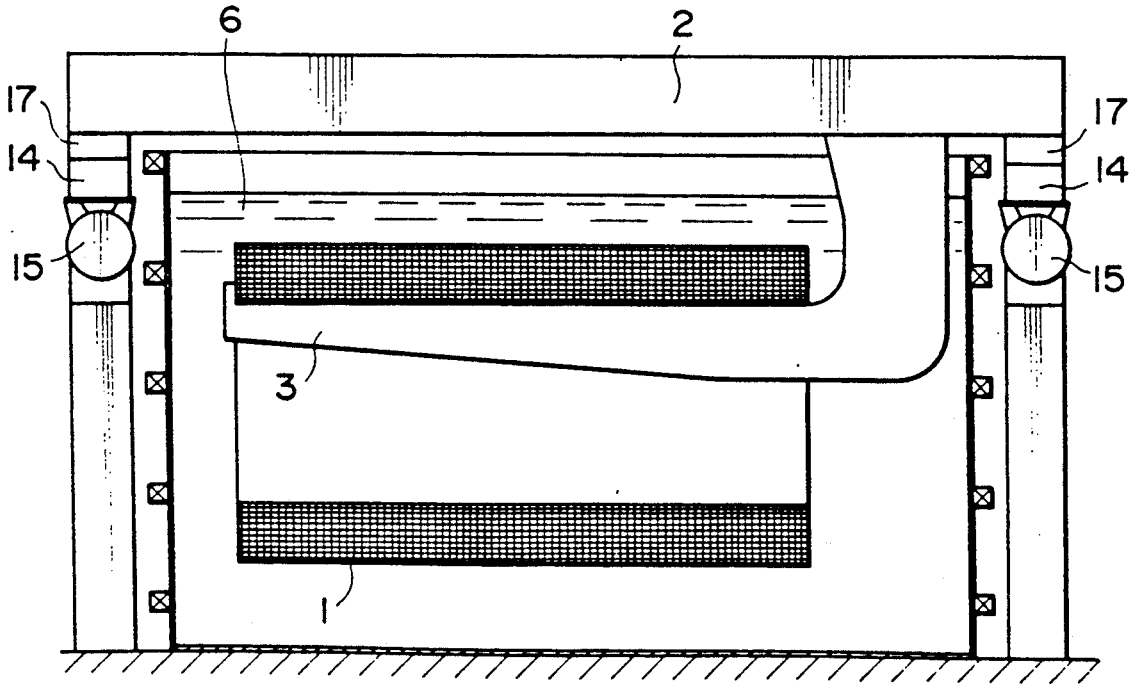
FIG. 12 (PRIOR ART)
FIG. 12 is a schematic front elevational view for showing another conventional embodiment
Figure 13:
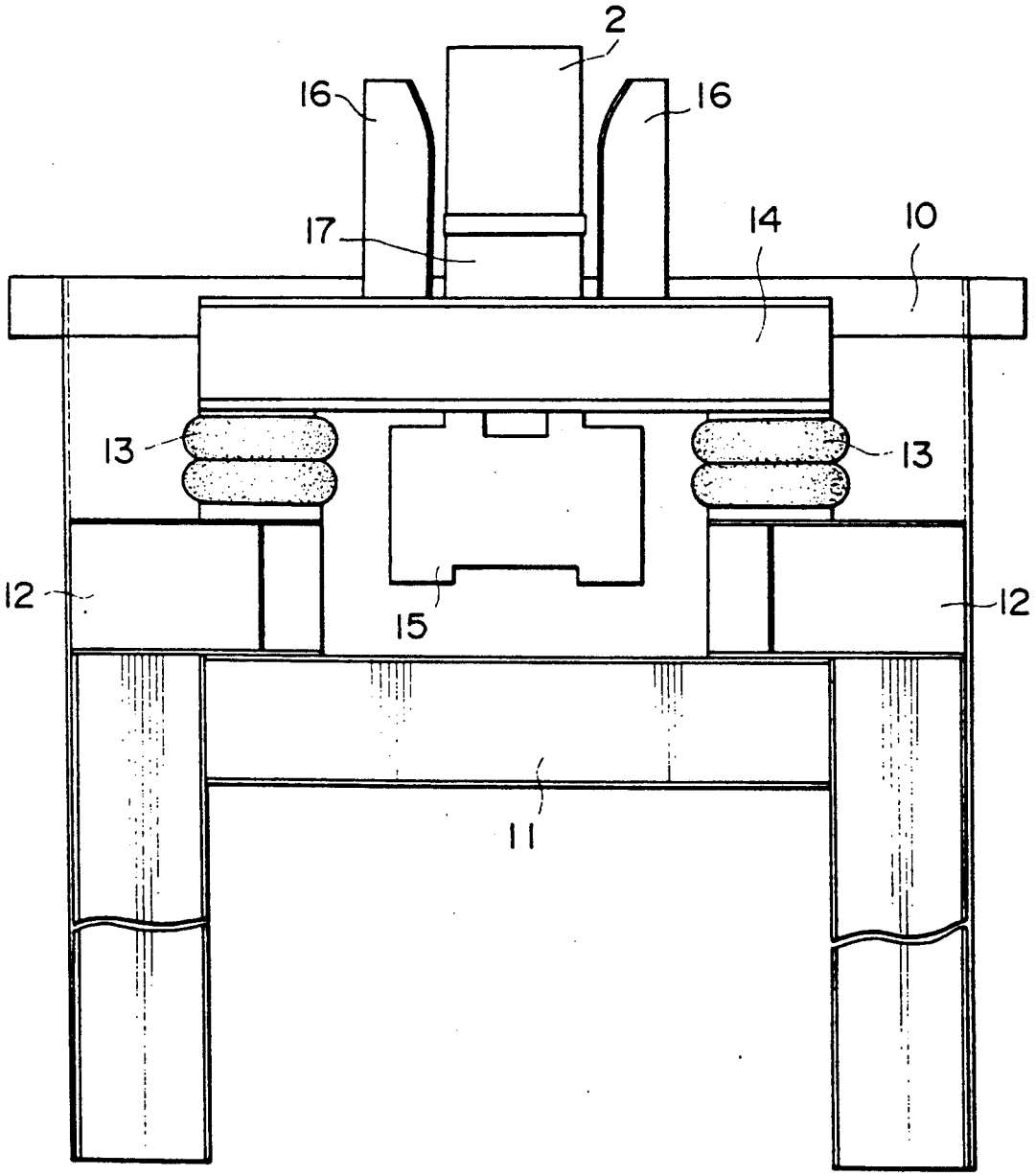
FIG. 13 (PRIOR ART)
FIG. 13 is a partially enlarged side elevational view of FIG. 12.

In order to resolve such problems as above, there has been proposed a surface processing device (a pickling device) in which a vibration applying device for applying an oscillation to the coil of wire material is arranged at the supporting frame for supporting the hook (Jap. U.M. Laid-Open No. Sho 61-69276) and this device has already been put practice. That is, as illustrated in FIGS. 12 and 13, one example of this device is constructed such that each of the frame-like mounting blocks 11 is arranged vertically outside the pickling tub 10. Each of the mounting blocks 11 is provided with a supporting seat 12, this supporting seat 12 has a shock dampening member composed of an air spring or a spring absorbing a vibration of the hook, an air spring 13 in this example of this figure, and then each of the supporting frames 14 is supported on it. To the upper surface of each of the supporting frames 14 is fixed an electromagnet 17 for use in fixing the hook 3 in order to make an integral formation of the hook 3 with the supporting frames. At the central part of the lower surface of the supporting frame 14 is fixed a vibration applying device 15 composed of a rotary vibrator, for example. At the upper surface of the supporting frame 14 is arranged a guide member 16 for use in guiding the introduction of each of the hooks 3 and holding it at a predetermined position. In case of processing the coil of wire material, the hooks 3 are guided by the guide members 16 under the coil 1 of wire material being hung, moved onto the supporting frames 14. The hooks 3 are thus attracted and fixed by the electromagnet 17 so as to immerse the coil 1 of wire material in the processing liquid 6. Then, under this state, the vibration applying device 15 of the supporting frames 14 is energized to apply a vibration to the coil of wire material 1 hung on the hook 3 and then the above-described process is carried out.

A device of this device solves the problems found in the first device to be resolved. However if a surface treatment is carried out with any type of the above-described devices, a new problem has been generated if an air spring is employed as a dampening device for the supporting frames for supporting the hooks having the coil of wire material hung thereon (although the dampening device 8 in FIG. 11 is of a coil spring, this is replaced by the air spring). That is, in case that the coil of wire material is to be processed with such a device as described above, it is necessary to set a setting height of the air spring acting as a dampening device. In general, an inner pressure of the air spring is set in such a manner that a height of the air spring becomes the most suitable standard height for a mean weight of a group of coils of wire materials to be processed for their surface treatment (for example, 2.5 torn if the coil of wire material of 1 to 4 tons is to be processed) and at the same time a surface treatment of the coils of wire materials is carried out. Accordingly, in case that the coils of wire materials are mounted on the supporting frames, a height of the air spring is variously changed by the weight of each of the coils of wire material. Due to the fact that an amount of air in the air spring is kept constant, it becomes higher or lower than the most suitable standard height specific to the spring (the most suitable height of the air spring in design) and thus the following problems may occur. That is, (a) a frequency of vibration of the air spring is varied, a rate of vibrationproofing is decreased and vibration is applied to a structure such as a surrounding building and the like;

(b) when the weight of the coil of wire material is low, the coil is projected out of the surface treatment tub and the processing is not uniformly carried out to cause a deterioration in quality of the processing surface to be attained;

(c) when the weight of the coil of wire material is low, a clearance between the handling part of the hook and the hanger of the crane becomes narrow to cause a certain trouble to arise during automatic transportation of the hook.

In regard to the above problems (a) and (b), the operator may, in response to a variation of the weight of the coil of wire material, adjust an inner pressure of the air spring to adjust a height of the air spring to have the most appropriate height, resulting in that the various problems described above may be resolved temporarily. However, such an operation above must be carried out for every operation, and it takes much time, resulting in that it may not only cause the working operation to be troublesome, but also cause an automatic operation to be hindered in relation to the problem of the above item (c), and then a production capability of the facility is hindered.

In order to accomplish the above-described objects, the method and apparatus for processing a vibratory surface of the present invention have the following configuration.

That is, as the method for processing the vibratory surface, a processed object is hung on a hook, the hook is supported by a supporting frame having an air spring to immerse the object in a surface treatment liquid, a height of the air spring is automatically adjusted to the most suitable standard height which is specific to the spring, thereafter the surface treatment is carried out while the hook is being vibrated.

In detail, the surface treatment liquid tub is installed, mounting tables are arranged at both sides of the tub, the supporting frames supporting hooks hanging the processed object are supported on the mounting tables through the air spring and at the same time the air spring is connected with the air source through a supplying and discharging valve, the supplying and discharging valve is opened or closed in response to a weight of the processed object, and an automatic opening or closing means for the supplying or discharging valve is operated for adjusting the height of the supporting frame to occupy the most suitable standard height.

Referring now to FIGS. 1 to 7, the preferred embodiment of the present invention will be described in detail.

A basic configuration of the vibratory surface processing apparatus for performing the present invention may be realized by a system in which an air spring is employed as a dampening device for the supporting frame for supporting the hook if the surface treatment devices of any type shown in FIGS. 11 and 12 are used. In particular, the system shown in FIG. 12 is a preferable one, so the present invention will be described hereinafter in reference to the system shown in FIG. 12.

That is, a supporting seat 12 is arranged at each of the mounting tables 11 vertically installed at both aides of the pickling liquid tub storing processing liquid. To the supporting seat 12 is fixed an air spring 13 acting as a dampening device for absorbing vibration of the hook 3. On the air spring 13 is mounted a supporting frame 14 for supporting the hook 3. At a central part of a lower surface of the supporting frame 14 is fixed a vibration applying device 15. On the upper surface of the supporting frame 14 is fixed a guide member 16 for guiding the introduction of the hook 3. To the upper surface of the supporting frame 14 is fixed an electromagnet 17.

Figure 1:
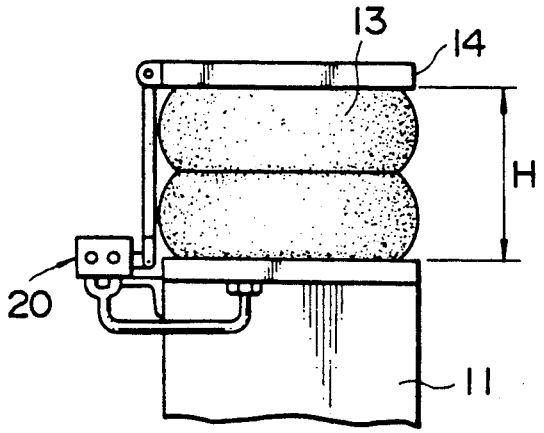
FIG. 1 is a schematic front elevational view for showing a dampening device in a surface treatment device for use in performing a vibratory surface treating method of the present invention.
Figure 2:
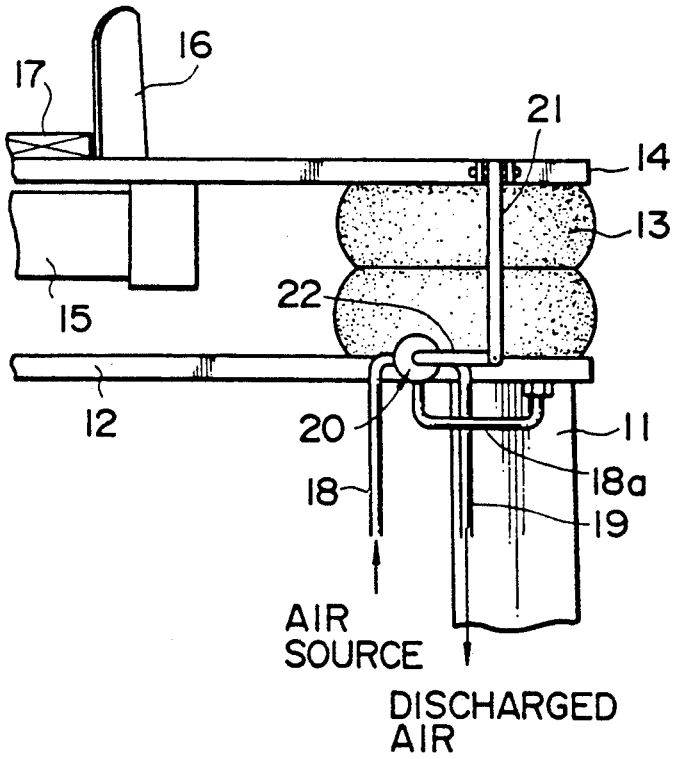
FIG. 2 is a side elevational view of FIG. 1.
Figure 3:
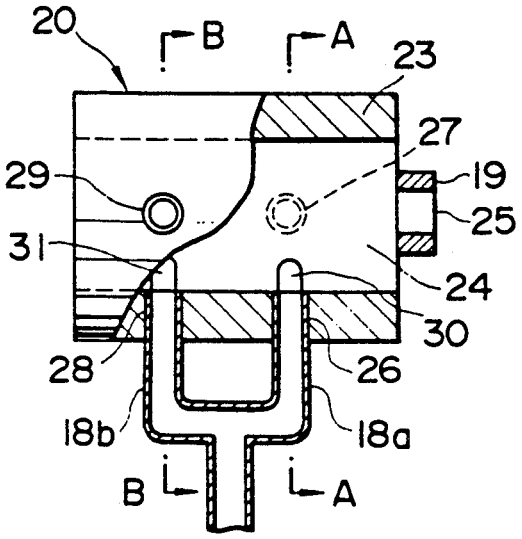
FIG. 3 is a front elevational view partly in section for showing a supplying and a discharging valve.
Figure 4:
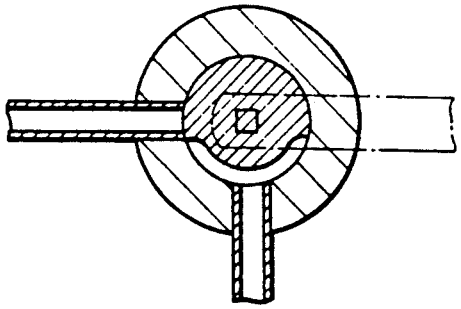
FIG. 4 is a sectional view taken along a line A—A of FIG. 3.
Figure 5:
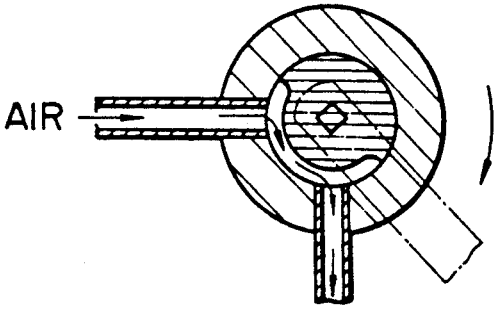
FIG. 5 is a sectional view for showing an operating state of the supplying and discharging valve.

As shown in FIGS. 1 and 2, the air spring 13 acting as the dampening device for the supporting frame 14 is provided with a mechanism for automatically adjusting the height of the supporting frame 14. A rotary supplying or discharging valve 20 is arranged in the mid-portion of an air supplying pipe 18 communicating with a pressurized air source (not shown) for supplying a compressed air to the air spring 13 and a discharging pipe 19 for releasing a pressure within the air spring 13. A rotary shaft 25 of this supplying and discharging valve 20 and the supporting frame 14 are connected by the first link member 21 and the second link member 22.

As shown in FIGS. 3 to 7, a detailed structure of the air supplying and discharging valve 20 is constructed such that a valve member 24 is rotatably inserted into a casing 23 and the rotary shaft 25 projecting from the valve member 24 is connected to the second link member 22. In the casing 23 of the supplying and discharging valve 20 are opened an air supplying port 26 to which an air supplying pipe 18*a* extending from the valve member 24 to the air spring 13 is connected and an air supplying port 27 to which the air supplying pipe 18 communicating with the pressurized air source the ports 26 and 27 being angularly spaced by a phase difference of 90°. An air discharging port 28 to which a pipe 18*b* branched from the air supplying pipe 18*a* leading from the casing 23 to the air spring 13 is connected, and a discharging port 29 by which the air discharging pipe 19 is opened to the surrounding atmosphere, are spaced with a phase difference of 90°. In turn, an outer circumference of the valve member 24 is provided with an air supplying communication passage 30 and an air discharging passage 31 which extend over a range of about 90° in correspondence with each of the positions of the air supplying ports 26, 27 and the air discharging ports 28 and 29, respectively. It is preferable that the air supplying communication passage 30 and the discharging communication passage 31 are provided such that the first link member 21 performs its vertical ascending or descending movement within a range of amplitude of the vibration applying device 15 as the supporting frame 13 is vibrated at the time of vibratory processing, resulting in that the second link member 22 is oscillated and the valve member 24 is repeatedly rotated at a quite small rotational angle. It is preferable that the air supplying communication passage 30 and the air discharging communication passage 31 are installed so as not to cause the air supplying pipe and the air discharging pipe to be communicated, in other words so as to allow their repetitive rotation to be attained.

Figure 6:
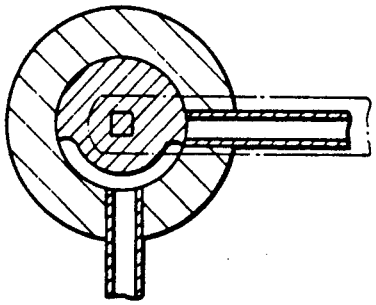
FIG. 6 is a sectional view taken along a line B—B of FIG. 3.
Figure 8:
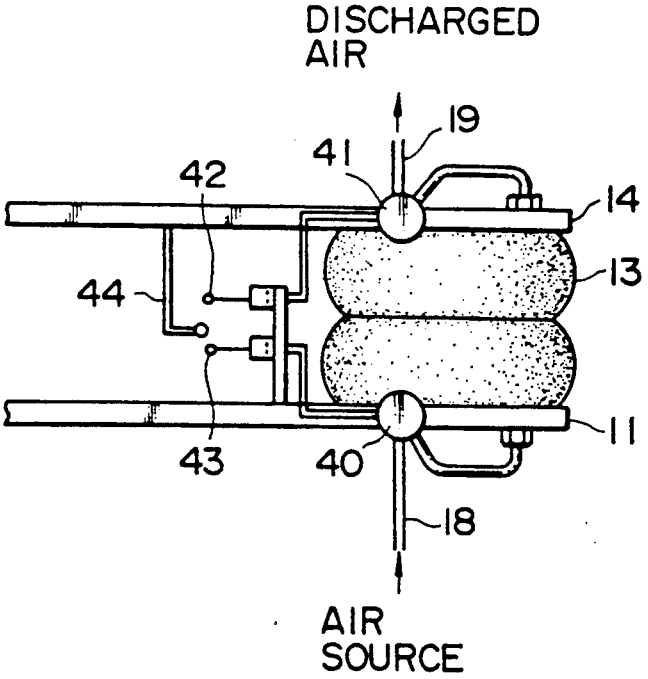
FIGS. 8 to 10 illustrate schematic front elevational views for showing another modified preferred embodiment of the dampening device.

In case of performing a vibratory surface treatment, compressed air is supplied to the air spring 13 in such a way as the height of the air spring becomes the most suitable standard height and the height H of the spring 13 is set to the most suitable standard height and at the same time a position of the valve member 24 in the air supplying and the air discharging valve 20 is set at a neutral position shown in FIGS. 6 and 8.

Figure 7:
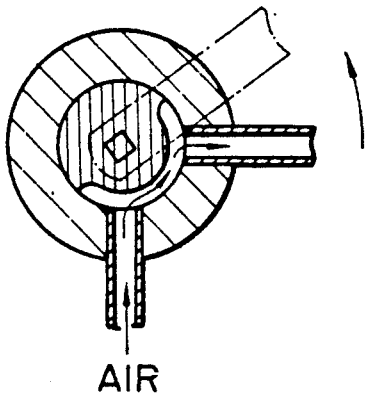
FIG. 7 is a sectional view for showing an operating condition of FIG. 6.

Under such a condition as above, a case in which the heaviest coil of a group of coil wire members to be surface treated is processed will be described. The hook 3 having the coil 1 of wire material hung therein is mounted on the supporting frame 13, the electromagnet 17 is energized to cause the hook 3 to be retracted against and fixed to the supporting frame 13 so as to make an integral formation with the supporting frame 13 and then the coil 1 of wire material is immersed in the surface treatment liquid 6 within the tub 10. At this time, as the supporting frame 13 is descended down by a weight of the coil 1 of wire material (a total weight including a weight of the hook 3), the first link member 21 fixed to this supporting frame 13 is simultaneously descended, thereby the second link member 22 is oscillated and the rotary shaft 25 of the air supplying and air discharging valve 20 connected to the second link member 22 is rotated and as shown in FIG. 7, the air supplying communication passage 30 arranged in the valve member 24 causes the air supplying port 27 to be communicated with the air supplying port 26. A compressed air is supplied to the air spring 13, the height of the air spring 13 is gradually recovered (ascended) and also the valve member 24 may start a returning rotation as the supporting frame 14 is ascended. At the time when the air spring 13 reaches the most suitable standard position corresponding to the weight of the coil 1 of wire material initially set, the air supplying ports 27 and 26 are closed and further a supplying of compressed air to the air spring is shut off, thereby an inner pressure in the air spring 13 and the weight of the coil 1 of wire material are balanced to generate the most suitable immersed condition.

After this operation, the vibration applying device 15 is energized, the hook 3 is vibrated so as to perform the surface treatment while oscillating the coil 1 of wire material. At this time, the hook 3 is strongly retracted against the supporting frame 14 with the electromagnet 17 so as to make an integral rigid connection.

Figure 9:
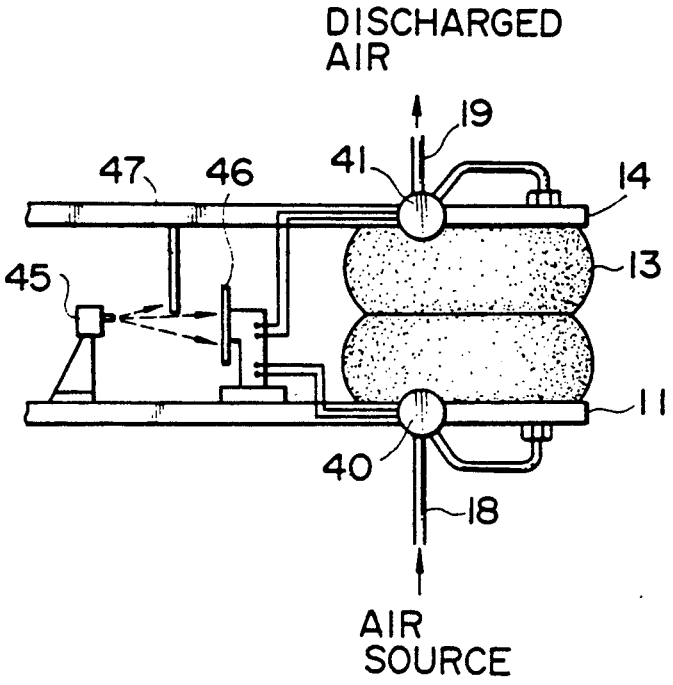

After this treatment, as the coil 1 of wire material is transported out, the load is removed from the supporting frame 14, so that the air spring 13 may start to ascend by its inner pressure. At this time, the first link member 21 is lifted up in opposition to the above-described action, the second link member 22 is pulled up to rotate the valve member 24, resulting in that, as shown in FIG. 9, the air discharging communication passage 31 arranged in the valve member 24 is communicated with the air discharging ports 28 and 29, the inner pressure of the air spring 13 passes through the branch pipe 18b and in addition the air is released into the surrounding atmosphere from the discharging pipe 19 through the air discharging communication passage 31. The spring is gradually returned back toward its initial set height, the valve 24 is rotated as the height is varied. As this is reached to the initial set height, communication of each of the ports 28 and 29 through the air discharging communication passage 31 is shut off and the spring is returned to its initial set height.

Although the above description provides a case in which the weight of the coil of wire material is the highest one, it should be understood that an automatic adjustment of the air spring 13 acting as the dampening device against its most suitable height for the supporting member 14 is carried out under an order to the above-described action irrespective of what weight of the coil of wire material is applied.

The preferred embodiment shown in FIG. 8 and its subsequent figures illustrate various modifications in the automatic height adjusting mechanism in the supporting frame. FIG. 8 illustrates a system in which in place of the integral type air supplying and discharging valve, independent control valves 40 and 41 are applied in the air supplying pipe and the air discharging pipe, an upper limit switch 42 and a lower limit switch 43 are arranged as a height adjusting mechanism and in turn a striker 44 for striking against the limit switches 42 and 43 is provided in the supporting frame 14. As the lower limit switch 43 is operated, the control valve 40 arranged in the air supplying pipe 18 is operated and as the upper limit switch 42 is operated, the control valve 41 arranged in the air discharging pipe 19 is operated. The automatic height adjustment of the supporting frame is the same as that of the above-described preferred embodiment.

In the preferred embodiment shown in FIG. 9, the height adjusting mechanism may perform an operation of a sensing means and an operation of the control valve in response to the sensing means, a light projecting unit 45 and a light receiving unit 46 are provided and then a light beam shielding plate 47 is arranged at the supporting frame 14 so as to cause it to be positioned between them.

Figure 10:
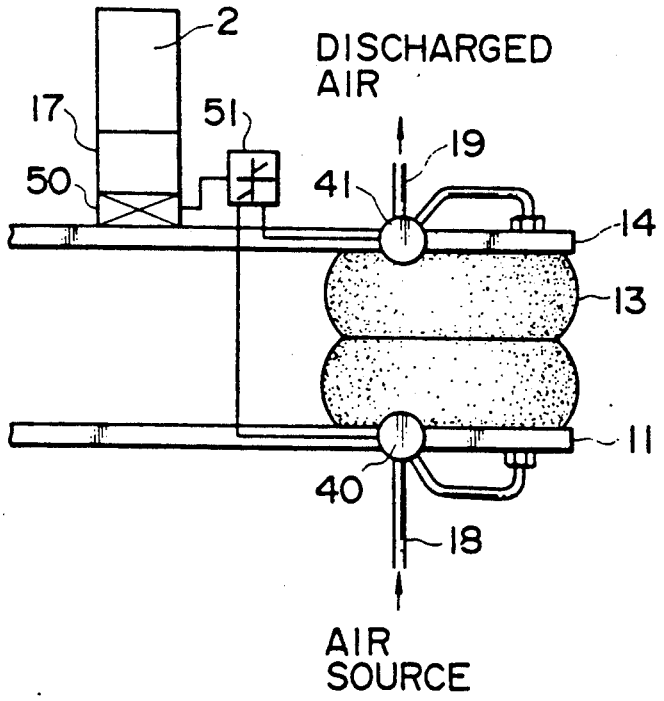

In addition, the system shown in FIG. 10 is constructed such that a load cell 50 is arranged at a mounting position of the hook 3 of the supporting frame 14 so as to measure a weight of the coil 1 of wire material by the load cell 50. This detected value is inputted to a function generator 51 so as to control the opening or closing of the control valves 40 and 41.

According to the present invention, in case of performing the vibratory surface treatment, the height of the supporting frame is automatically adjusted, thereby even if the weight of the processed object is varied, the immersing depth in the processing liquid for the processed object can be automatically adjusted and so a deterioration of quality of the surface can be prevented and in case of performing the vibratory surface treatment, a specific frequency of vibration of the dampening device is made as the most suitable one so as to prevent the influence of the vibration on the surrounding environment such as a building and at the same time the automatic transportation can be realized to make a remarkable effect in the industry.

What is claimed is:

1. A method for processing a vibratory surface of an object to be processed, comprising the steps of:

hanging the object on a hook, supporting said hook by a supporting frame having an air spring;

immersing the object hung on the hook in a surface treatment tub containing a processing liquid, automatically adjusting the height of the air spring to a suitable standard height in response to the detected weight of the processed object, and thereafter vibrating the surface so as to treat the object.

2. The method of claim 1 wherein said supporting step comprises using an electromagnet to hold said hook on the supporting frame.

3. The method as defined in claim 1 wherein said automatic adjusting step comprises selectively supplying compressed air to an air spring via an air supplying and discharging valve.

4. The method as defined in claim 1 including the step of detecting the weight of the processed object by measuring the height of the air spring with the hook supported on the frame.

* * * * *